US007225742B2

(12) United States Patent
Radchenko

(10) Patent No.: US 7,225,742 B2
(45) Date of Patent: Jun. 5, 2007

(54) ARROW-SHAPED BULLET, AMMUNITION CARTRIDGE USING SAME, AND METHOD OF MANUFACTURING SAME

(76) Inventor: Mihail Yur'evich Radchenko, ul. Sheremetievskaya, 19-74, Moscow, 127521 (RU)

( * ) Notice: Subject to any disclaimer, the term of this patent is extended or adjusted under 35 U.S.C. 154(b) by 14 days.

(21) Appl. No.: 10/535,615

(22) PCT Filed: Nov. 18, 2003

(86) PCT No.: PCT/RU03/00501

§ 371 (c)(1),
(2), (4) Date: May 19, 2005

(87) PCT Pub. No.: WO2004/046637

PCT Pub. Date: Jun. 3, 2004

(65) Prior Publication Data

US 2006/0048666 A1 Mar. 9, 2006

(30) Foreign Application Priority Data

Nov. 20, 2002 (RU) ..... 2002131148

(51) Int. Cl.
*F42B 10/006* (2006.01)

(52) U.S. Cl. ..... 102/438; 102/518; 102/529

(58) Field of Classification Search ..... 102/438, 102/703, 518, 501–529
See application file for complete search history.

(56) References Cited

U.S. PATENT DOCUMENTS 3,063,376 A 11/1962 Powell
3,545,383 A * 12/1970 Lucy ..... 102/517
5,339,743 A * 8/1994 Scarlata ..... 102/439
5,515,785 A * 5/1996 Zglenicki ..... 102/473
2002/0184995 A1* 12/2002 Beal ..... 86/55

FOREIGN PATENT DOCUMENTS

WO WO01/88462 A1 11/2001

OTHER PUBLICATIONS

International Search Report for PCT/RU2003/000501 dated Mar. 18, 2004.

* cited by examiner

*Primary Examiner*—Michelle Clement
*Assistant Examiner*—John Holman
(74) *Attorney, Agent, or Firm*—Barmdesser Law Group

(57) ABSTRACT

The invention relates to ammunition for fire and pneumatic smoothbore weapon and can be used for producing bullets for hunting and sporting guns. The inventive method consists in deforming the rear part of a tubular blank in such a way that an aerodynamic empennage is formed and in arranging a core in the front part of said blank. The core is introduced into the tubular blank prior to deforming and is fixed in said blank by deforming the front and rear parts thereof. Deformation is carried out by pressing the blank wall without modifying the thickness thereof. The deformation of the tubular blank can be carried out by longitudinally clamping said blank between two crimping matrixes. Said core is embodied in such a way that an extractor in the form of an aerodynamic needle is formed in the material thereof, the core being inserted when said extractor is disposed outside the internal volume of the blank.

22 Claims, 5 Drawing Sheets

ARROW-SHAPED BULLET, AMMUNITION CARTRIDGE USING SAME, AND METHOD OF MANUFACTURING SAME

FIELD OF THE INVENTION

The invention relates to ammunition for firearms and pneumatic smooth-bore weapons and can be used for producing bullets for cartridges for hunting and sporting guns.

BACKGROUND ART

An arrow-shaped bullet is known in the conventional art. This bullet is produced from a solid bar, the front part of which is tapered and the rear part of which is deformed to create an aerodynamic empennage (tail section) in the shape of longitudinal surfaces (see U.S. Pat. No. 3,846,878, published on Nov. 12, 1974).

The disadvantage of the method for producing such a bullet is its high manufacturing complexity.

Another method for producing an arrow-shaped bullet is known in the conventional art, see U.S. Pat. No. 5,515,785, published on May 14, 1996. This method deforms the rear part of a tubular blank to create an aerodynamic empennage (tail section) and insert a functional filling (core) in the tube's cavity. The rear part of a tubular blank is deformed by inelastic deformation (plastic flow) of the tube's material, and the thickness of the tube's walls is altered.

After the empennage is formed, a core is inserted in the tube's cavity. A core can have a granular or jelly filling, e.g., a load released at the moment the bullet hits the target. This core is kept in the tube's cavity by friction or capillary forces. This method is not used for inserting solid cores, e.g., metal cores.

The disadvantage of this method is its high manufacturing complexity. Also, a bullet produced by this method cannot be used for commercial or sport hunting.

A cartridge comprising a shell having means for inflammation (a primer), a propelling charge, a damage agent, and one or more wads is also known in the conventional art (see U.S. Pat. No. 5,239,928, published on Aug. 31, 1993). The drawback of this cartridge is that it is not possible to use arrow-shaped bullets.

DESCRIPTION OF THE INVENTION

Figure 1:
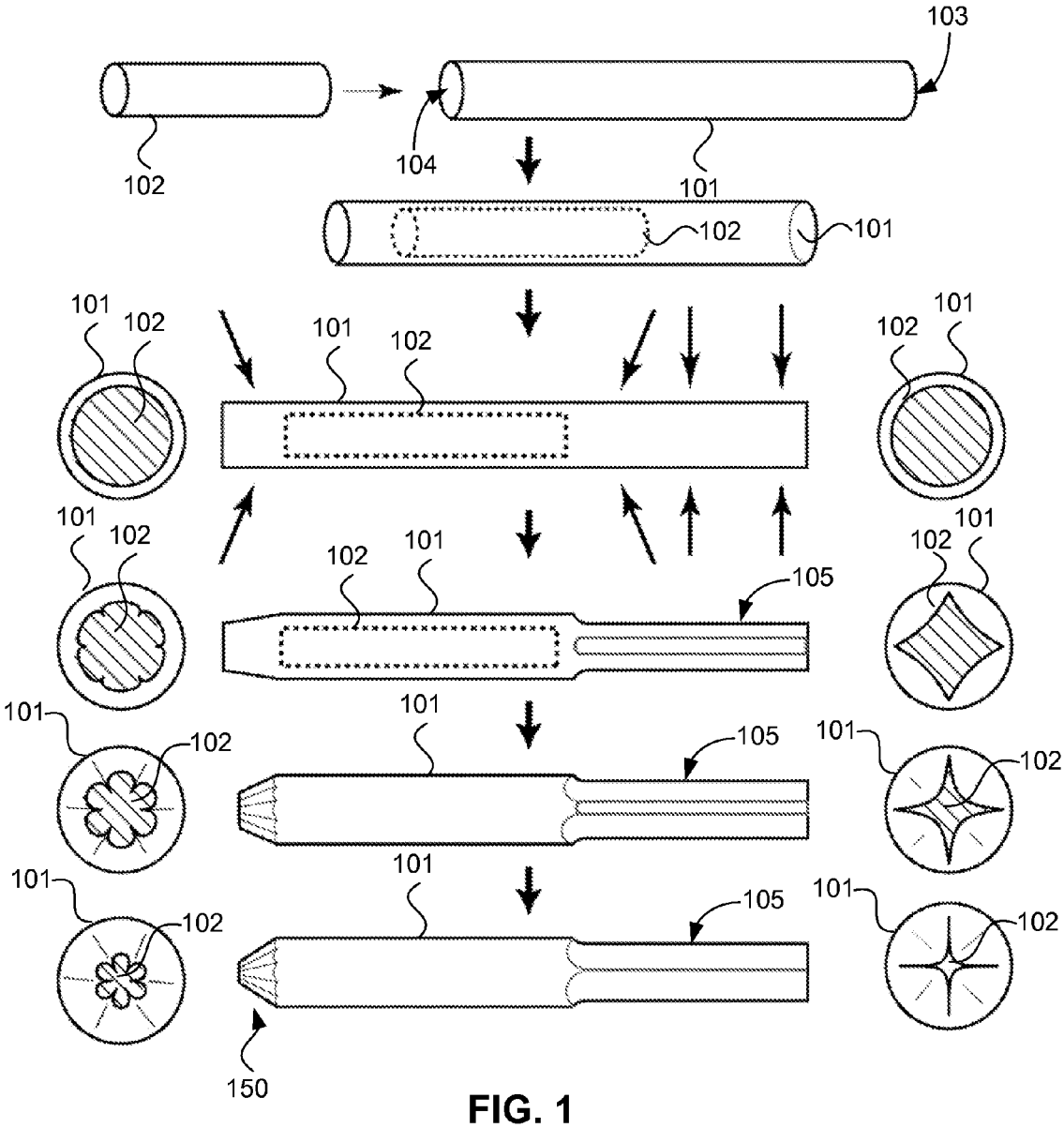
FIG. 1 illustrates a method for producing a bullet according to the claimed method.

The object of the present invention is to remove the above drawbacks, namely, to develop an inexpensive relatively simple method for producing a bullet suitable for different kinds of targets and having low aerodynamic resistance, and also to develop an ammunition (cartridge) in which this bullet is used.

In order to achieve this object, a method for producing an arrow-shaped bullet includes the steps of deforming the rear part 103 (see FIG. 1) of a tubular blank 101 to create the aerodynamic empennage (tail section, or tail fins) and inserting a core 102 inside the front part 104 of the tubular blank. The core 102 is inserted in the tubular blank 101 before its deformation. The core 102 is fastened inside the blank 101 by a simultaneous deformation of the front and rear parts (104, 103) of the blank 102, to form a taper 150 on the front portion of the blank. The deformation is carried out by pressing the blank walls without altering the thickness thereof.

A second object of the invention is a bullet produced by the method described above.

Figure 2:
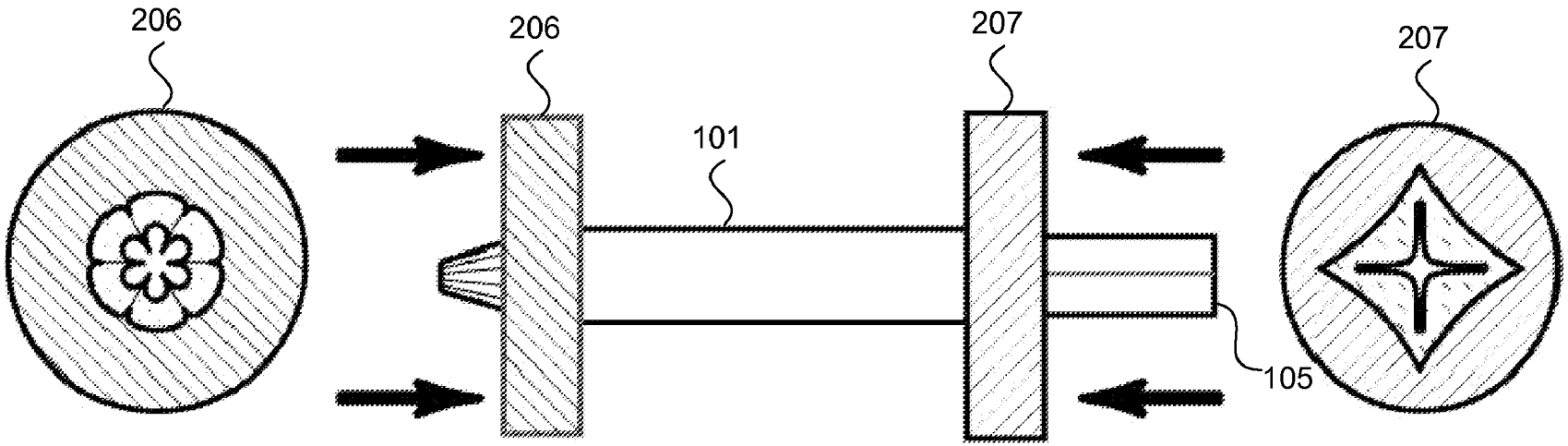
FIG. 2 illustrates a method of longitudinally clamping a blank between two crimping matrixes.
Figure 3:
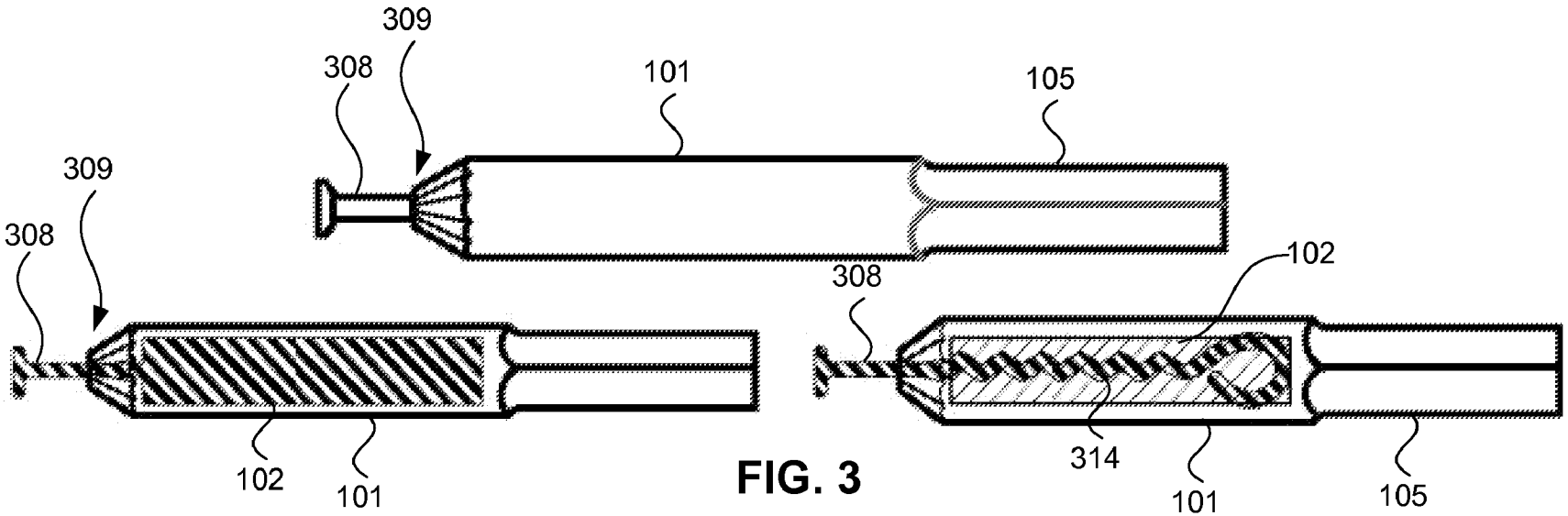
FIG. 3 illustrates a bullet with an extractor in the shape of an aerodynamic needle.

In the preferred embodiments of the invention, the deformation is carried out by longitudinally clamping the blank 101 between two crimping matrices 206, 207 (see FIG. 2). In order to keep the bullet inside the ammunition, and while it moves up the bore in the front part of the core 102, an extractor 308 is added to the core's material, and the core 102 is inserted in the blank 101 (see FIG. 3). The extractor 308 protrudes beyond the edge 309 of the blank 101, to make it possible to clamp the front part of the blank 101.

Figure 4:
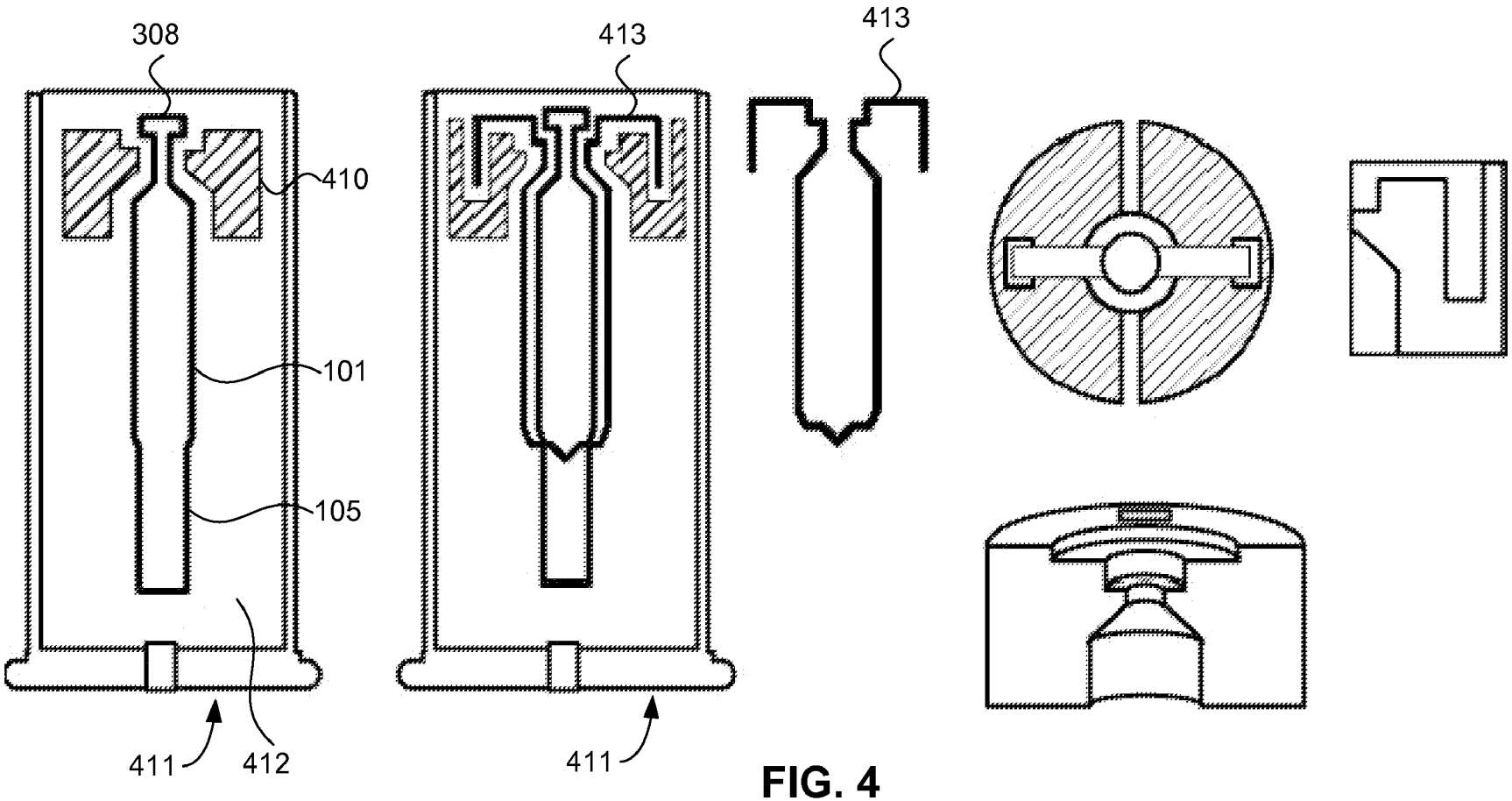
FIG. 4 illustrates the ammunition cartridge with muzzle wads and a bullet having an extractor in the shape of an aerodynamic needle and the ammunition in which the damage agent is further fastened with a spring.

The extractor 308 is formed to be geometrically coupled with the muzzle wad 410 (see FIG. 4). When the core 102 is produced as a combination of a metal armoring rod and a soft filling, the extractor 308 is made of the metal of the core's rod. The extractor 308 can be formed in the shape of an aerodynamic needle, in order to improve the bullet's aerodynamic properties. The core is formed as a set of damage agents in order to increase the impact effect of the bullet.

Another object of the invention is providing an ammunition cartridge 411 comprising a shell with a means of inflammation (primer), a propelling charge 412, one or more wads 410, and a damage agent, including one or more bullets produced by the method described above.

To fasten a damage agent in the ammunition 411, a securing spring 413 is further added that generally follows the shape of the damage agent in the compressed state and thereby keeps the compressed shell. The spring 413 is fastened in the segments of the muzzle wad 410. The damage agent is inserted therein. A spring 314 is elastically deformed by compressing it and fixing it inside the damage agent and the spring 413 is inserted in the compressed state in the ammunition.

Figure 5:
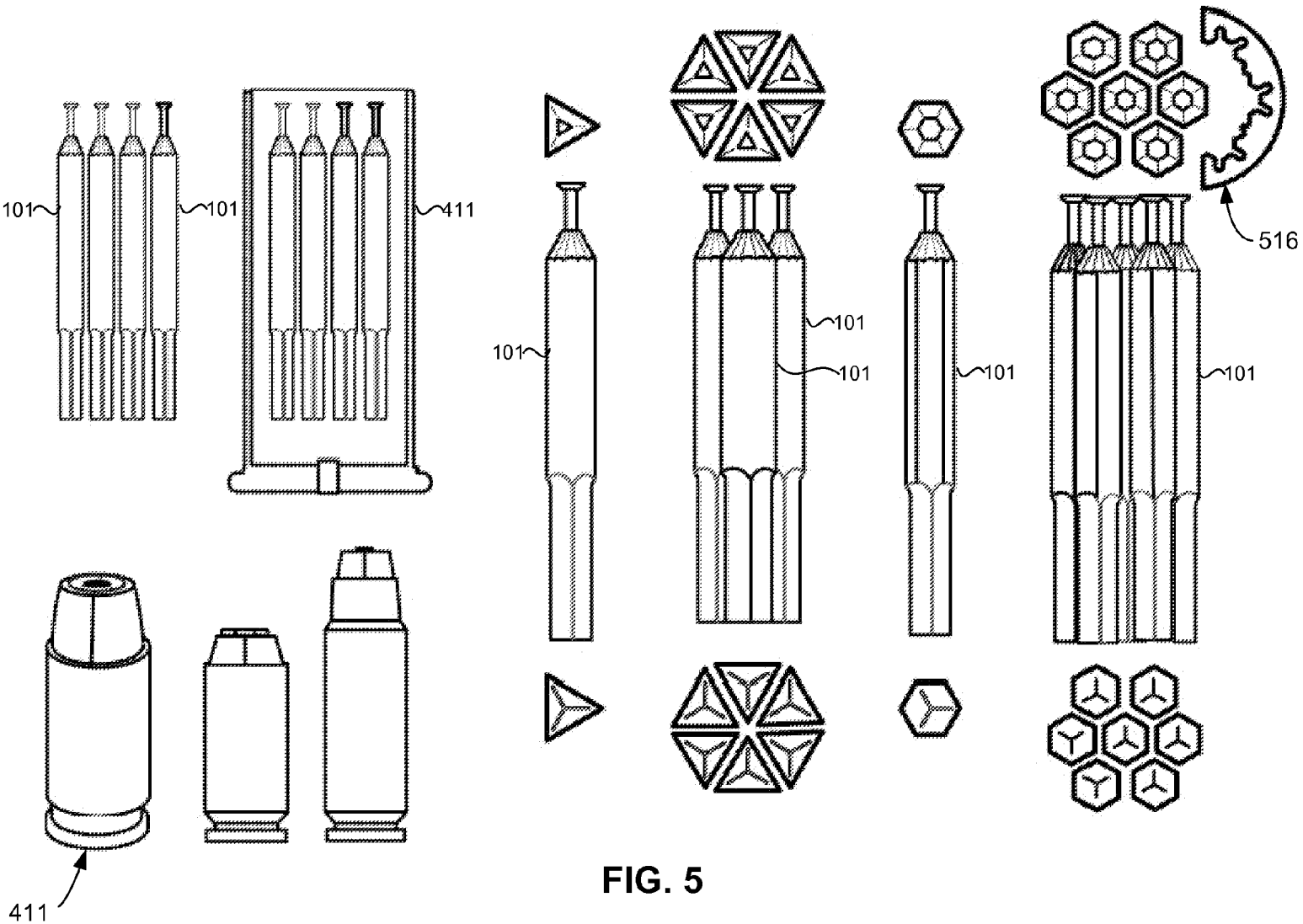
FIG. 5 illustrates a multi-bullet ammunition cartridge, with bullets fastened through the bottom wads, and single-bullet ammunition cartridge.

In order to fasten several bullets in a simple cartridge 411, a through bottom wad 516 is further produced having openings for the surfaces of the bullets' tail sections 105. The wad is inserted in the ammunition in such a way that the wad is inserted between the propelling charge and the bullets' central portions 308. The surfaces of the bullets' tail sections 105 fit into the wad's openings, and the bullets' tail sections 105 protrude beyond the wad's forward boundary and are inserted into the propelling charge's material. As shown in FIG. 5, the central portion of the blank 101 can be shaped as a polygon in cross-section, e.g., a triangle, hexagon, etc., or may be round/circular in cross-section, as shown in FIG. 1.

I claim:

1. A method for producing an arrow-shaped bullet, the method comprising:

inserting a solid core in a shape of a rod into a tubular blank;

compressing a tail portion of the tubular blank to form a plurality of tail fins; and compressing a front portion of the tubular blank to form a taper, wherein a thickness of the walls of the tubular blank, throughout its length, is the same before and after the compressing steps.

2. The method of claim 1, wherein both compressing steps are performed simultaneously.

3. The method of claim 1, wherein the compressing steps comprise longitudinally clamping the tubular blank between two crimping matrices.

4. The method of claim 1, wherein the core further comprises an aerodynamic needle extending beyond the front portion.

5. The method of claim 4, wherein a portion of the aerodynamic needle inside the core is shaped as a spring.

6. An ammunition cartridge comprising:

a tubular blank having a tail section in a shape of tail fins and a front section in a shape of a taper;

a solid core in a shape of a rod inside the tubular blank between the front and tail section, wherein a thickness of the walls of the tubular blank is the same throughout its length; and a casing having a propellant therein, the casing mated to the tubular blank.

7. The cartridge of claim 6, further comprising an aerodynamic needle extending from the core and beyond the front portion.

8. The cartridge of claim 7, further comprising a muzzle wad such that a tip of the aerodynamic needle extends beyond an edge of the muzzle wad.

9. The cartridge of claim 7, wherein the aerodynamic needle includes a portion embedded in the core that is shaped as a spring.

10. The cartridge of claim 7, wherein the tubular blank has a round cross-section.

11. The cartridge of claim 7, wherein the tubular blank has a polygonal cross-section.

12. An ammunition cartridge comprising:

a plurality of bullets adjacent to each other and positioned inside a casing;

each bullet comprising a tubular blank having a tail section in a shape of tail fins and a front section in a shape of a taper;

each bullet further comprising a solid core in a shape of a rod inside the tubular blank between the front and tail section;

each bullet further comprising an aerodynamic needle extending from the core beyond the front section; and a muzzle wad located in a front portion of the casing such that forward tips of the aerodynamic needles extend beyond the muzzle wad.

13. The cartridge of claim 12, wherein a thickness of the walls of each blank is the same throughout its length.

14. The cartridge of claim 12, wherein each tubular blank has a polygonal cross-section.

15. The cartridge of claim 12, wherein each tubular blank has a round cross-section.

16. A bullet comprising:

a tubular blank having a tail section in a shape of tail fins and a front section in a shape of a taper; and a solid core in a shape of a rod inside the tubular blank between the front and tail sections, wherein a thickness of the walls of the blank is the same throughout its length.

17. The bullet of claim 16, further comprising an aerodynamic needle projecting forward from the solid core and beyond the front section.

18. The bullet of claim 17, wherein the aerodynamic needle includes a portion embedded in the core and having a shape of a spring.

19. A method for producing an arrow-shaped bullet, the method comprising:

inserting a core into a tubular blank;

compressing a tail portion of the tubular blank to form a plurality of tail fins; and simultaneously compressing a front portion of the tubular blank to form a taper, wherein a thickness of the walls of the tubular blank, throughout its length, is the same before and after the compressing steps.

20. The method of claim 19, wherein the core further comprises an aerodynamic needle extending beyond the front portion, and wherein the front portion is compressed around the aerodynamic needle.

21. The method of claim 19, wherein a portion of the aerodynamic needle inside the core is shaped as a spring.

22. The method of claim 19, wherein the core is a solid in a shape of a rod.

* * * * *